US005268084A

United States Patent [19]

McCoy et al.

[11] Patent Number: 5,268,084

[45] Date of Patent: Dec. 7, 1993

[54] ANTIMONY-LITHIUM ELECTRODE

[75] Inventors: Lowell R. McCoy, Woodland Hills; Laszlo A. Heredy, Irvine; LeRoy F. Grantham, Calabasas, all of Calif.

[73] Assignee: Rockwell International Corporation, Seal Beach, Calif.

[21] Appl. No.: 793,922

[22] Filed: Nov. 18, 1991

[51] Int. Cl.[5] ..... C25B 11/06; G01N 27/26

[52] U.S. Cl. ..... 204/290 R; 204/290 F; 204/435

[58] Field of Search ..... 204/290 F, 1.5, 67, 204/64, 70, 431, 433, 435; 420/400, 576; 429/44

[56] References Cited

U.S. PATENT DOCUMENTS

| | | | |
|---|---|---|---|
| 3,742,594 | 7/1973 | Kleinberg | 204/433 |
| 3,898,096 | 8/1975 | Heredy et al. | 136/6 F |
| 4,430,188 | 2/1984 | Cohn | 204/290 F |
| 4,975,161 | 12/1990 | Nidola et al. | 204/98 |
| 5,017,276 | 5/1991 | Alford et al. | 204/290 |
| 5,085,955 | 2/1992 | Cipriano | 429/218 |
| 5,183,543 | 2/1993 | Toyosawa et al. | 204/290 R |

OTHER PUBLICATIONS

Wang et al., Behavior of Some Binary Lithium Alloys as Negative Electrodes in Organic Solvent-Based Electrolytes; pp. 457-460; Mar. 1986.

*Primary Examiner*—Kathryn Gorgos

*Attorney, Agent, or Firm*—H. Fredrick Hamann; Harry B. Field; David C. Faulkner

[57] ABSTRACT

An electrode is provided comprising a metal base and, on at least a portion of the metal base, a conductive material comprising a metallic mixture of antimony and lithium. This electrode may be utilized in an apparatus for electrochemical treatment of radioactive waste.

4 Claims, No Drawings

ANTIMONY-LITHIUM ELECTRODE

BACKGROUND OF THE INVENTION

1. Field of the Invention

This invention relates to an improved metallic electrode and more particularly to a combination reference and working metallic electrode comprising a metallic mixture of antimony and lithium.

The metal electrode of the present invention finds utility in electrolytic cells for chemical production as well as in the molten salt treatment processing of nuclear fuel and the molten salt treatment of radioactive waste.

2. Description of Related Art

A need exists for a metal electrode capable of long-term stability when utilized in electrolytic cells for chemical production as well as in molten salt systems concerned with nuclear fuel processing and treatment of radioactive waste.

U.S. Pat. No. 5,017,276 of May 21, 1991 teaches metal electrodes provided with a coating consisting essentially of a mixed oxide compound, which metal electrode may be useful for electro-chemical processes.

U.S. Pat. No. 4,975,161 of Dec. 4, 1990 provides electrodes for use in electro-chemical processes, particularly as cathodes for hydrogen evolution in cells for the electrolysis of alkaline metal halides, the electrodes comprising an electrode with a ceramic coating obtained by thermal deposition.

U.S. Pat. No. 3,898,096 of Aug. 5, 1975 discloses a high-temperature lithium-molten salt power-producing secondary cell having improved cycle life on repeated charge and discharge cycles utilizing a selected transition metal chalcogenide as the electrochemically active material of the positive electrode.

However, heretofore electrodes useful in the applications described above are deficient with respect to long-term stability when directly immersed in a molten salt mixture (LiCl-KCl) containing various metals such as aluminum, lanthanide and actinide chlorides.

SUMMARY AND OBJECTS OF THE INVENTION

According to the present invention, there is provided a metallic electrode comprising a metal base and, on at least a portion of said metal base, a conductive coating comprising a metallic mixture of antimony and lithium.

The present invention may be applied to electrochemical cells, in which lithium is the active species, and more particularly to electrochemical cells having a molten salt electrolyte. Another utility of the present invention resides in treatment of spent nuclear fuel and of waste generated from various nuclear plants. Still another utility of the present invention is the electrowinning of metals such as aluminum in processes utilizing molten salts.

It is an object of the present invention to provide an electrode capable of long-term stability when directly dispersed or utilized in a molten salt environment.

It is a further object to provide an electrode containing lithium metal or other active metal.

Yet another object of the invention is to provide an electrode possessing a melting point in excess of 580° C.

Another object is an electrode exhibiting a stable voltage maintained over a suitable range of component concentrations and having a low voltage potential.

DETAILED DESCRIPTION OF THE PREFERRED EMBODIMENT

Accordingly, the invention provides a metallic electrode comprising a metal base of tantalum and, on at least a portion of the metal base, a conductive coating of a metallic mixture of antimony and lithium in which the conductive coating comprises from 5–50 atom percent lithium.

In preparing a metallic electrode in accordance with the present invention, a 1 millimeter diameter tantalum wire of about 6 inches in length is cleaned of any oxide by abrasion and in a clamp and vise apparatus, one end of the wire is curled around a mandrel 1/16 inch in diameter resulting in three curls at right angles to the long piece of tantalum wire. Thereafter in an inert atmosphere glove box containing an inert tantalum crucible, there is introduced 13.3 grams of antimony and 1.04 grams lithium. The mixture of the lithium and antimony metal is melted and stirred until a uniform molten mixture results.

The metallic electrode metal base which has been previously crimped to form a hollow cylindrical void is then repeatedly immersed within the uniform molten mixture of lithium metal and antimony metal until the hollow cylindrical void is filled with an alloy mixture of lithium metal and antimony metal. Following immersion, the finished metalic electrode is removed and stored for ultimate disposition.

Although the metallic electrode metal base is preferably made of tantalum wire, the base can also comprise a non-reactive, conducting, high melting material such as platinum, tungsten and low carbon iron.

Alternately, a metallic electrode can be prepared by filling a screen body of cylindrical shape with pieces of the solidified previously melted and homogenized lithium antimony mixture containing from 5–50 atom percent lithium. The cylinder of $Li_2Sb$ pieces is closed by sewing, welding or other means and an electrical conductor of the electrode metal base is attached by welding. The cylindrical shaped body is fabricated from screen woven from wires of the metalic electrode base metal.

As mentioned hereinabove, the present invention also relates to a electrochemical treatment method using an apparatus having a container for holding a molten matter of a radioactive waste, electrodes contacting the molten matter and a power source for applying a voltage between the electrodes to effect separation of radioactive waste in the molten electrolyte.

Another application of the present invention is in the production of aluminum from molten salts containing aluminum by an electrochemical treatment using an apparatus having a container for holding a molten aluminum-containing salt, electrodes contacting the molten matter and a power source for applying a voltage between the electrode to deposit aluminum from the electrolyte.

In operation, an electric current would be applied to electrodes, which electrodes would comprise those of the present invention, while simultaneously changing the voltage to electrodeposit specific waste components from the molten salt for ultimate disposition as a stabilized radioactive solid lacking specific long half life components. In this mode of operation, the electrode of the present invention acts as a working electrode and supplies or absorbs lithium ions to or from the operation system.

In addition to the use of the described metallic electrode in the treatment of radioactive waste, the electrode may be used in electrochemical separation processes. In electrochemical separations, an applied voltage to a cathode (electrode where positive ion i.e. metals plate out) must be controlled very carefully in order not to apply sufficient voltage (same as potential) to plate out elements other than the desired material. If too much voltage is applied, elements other than the desired material will plate out and separation will not be effected.

To measure the voltage applied to the electrode, there required the use of a reference electrode. A reference electrode is an electrode that generates a known potential against which other potentials can be measured.

For aqueous systems, the best known reference electrode is the calomel electrode KCl-HgCl/Hg where the HgCl is dissolved in an aqueous KCl solution. For molten salt systems, the best known reference electrode is a silver/silver chloride electrode i.e. LiCl-KCl-AgCl/Ag where the AgCl is dissolved in a mixture of molten LiCl-KCl eutectic. Neither of these reference electrodes are primary standards since the potential depends on the amount of HgCl or AgCl dissolved. However, once the amount of material dissolved is measured, the potential can be calculated and is reproducible and known with great accuracy (4 places).

Other examples of standard molten salt electrodes are the chlorine electrode and the LiAl electrode. The chlorine electrode, LiCl-KCl/$Cl_2$ on a carbon or graphite substrate, is very hard to use since free chlorine is involved. The LiAl/LiCl-KCl electrode is easy to use but produces too high a voltage for many uses such as fuel processing or aluminum electrowinning.

On the other hand, a $Li_2Sb$/LiCl-KCl reference electrode is easy to use and produces a voltage ideal for nuclear fuel processing application i.e. the electrodeposition of actinides in the presence of rare earths or lanthanide chlorides in molten electrolytes or electrowinning aluminum from melts containing aluminum salts.

The potential of the $Li_2Sb$/LiCl-KCl reference electrode versus the chlorine electrode is $-2.7635$ volts at 450 degrees Centrigrade in eutectic LiCl-KCl electrolyte. The $Li_2Sb$ standard potential versus the chlorine standard potential varies with temperature according to the equation $-2.9759+0.000472(°C.)$ from 400 to 500 degrees Centrigrade.

A suitable reference electrode of the invention for long term commercial use can be constructed by the dip or screen technique placed in a non-corroding electrical insulator of open ended cyclindrical design which is inserted in a metal sheath to enhance ruggedness. The electrical insulator can be composed of $Al_2O_3$, $ZrO_2$, MgO, BN or other material which will not corrode in molten salt applications. The metal sheath has one or more openings at the bottom and along the side to facilitate molten salt contact.

The relative potentials for the rare earths, actinides, and reference electrodes relative to a silver/silver chloride reference electrode are given in Table 1.

TABLE 1

| Relative Potentials of Materials @ 450° C. | | |
|---|---|---|
| Material | Reaction | Potential *(Volts) |
| Lithium | $Li \rightleftharpoons Li^{+}e^{-}$ | 2.34 |

TABLE 1-continued

| Relative Potentials of Materials @ 450° C. | | |
|---|---|---|
| Material | Reaction | Potential *(Volts) |
| Lithium Aluminum | $Li_xAl \rightleftharpoons LiAl + Li^{+} + e^{-}$ | 2.15 |
| Rare Earths | $M \rightleftharpoons M^{+3} + 3e^{-}$ | 2.00 to 2.08 |
| Plutonium | $Pu \rightleftharpoons Pu^{+3} + 3e^{-}$ | 1.80 (1.68 to 1.84) |
| Neptunium | $NP \rightleftharpoons NP^{+3} + 3e^{-}$ | 1.70 (1.58 to 1.72) |
| Lithium Antimony | $Li_2Sb \rightleftharpoons Li^{+} + e^{-}Li_2Sb$ | 1.55 |
| Uranium | $U \rightleftharpoons U^{+3} + 3e^{-}$ | 1.45 (1.41 to 1.52) |

*Actual potential of rare earth and actinide system vs $A_g/A_gCl$ reference electrode varies with concentration and temperature; the potential specified is a median potential for active metal chlorides that might be observed in process applications; the rare earth potential varies with the rare earth used in the range given.

As can be seen in Table 1, the lithium aluminum has a higher potential than any of the rare earths and actinides. Therefore, when the lithium aluminum electrode is immersed in molten salts containing these materials, the lithium in the electrode will replace the actinides and rare earth materials in solution as shown in equations 1 and 2.

$$LiAl_{(S)}+PuCl_3 \rightarrow 3LiCl+LiAl_{(S)}+Pu \quad (1)$$

$$LiAl_{(S)}+MCl_3 \rightarrow 3LiCl+LiAl_{(S)}+M \quad (2).$$

The plutonium or other active metal (M) will plate out on the $LiAl_{(S)}$ solid electrode and gradually reduce the potential toward that of the active metal.

The lithium antimony, on the other hand, will be stable in the presence of active metals except possibly for uranium; the reactions in Equations 1 and 2 will not occur. The potential of uranium is close to that of the lithium antimony potential and the reaction shown in Equation 2, if it occurs, is not sufficient to interfere with the $Li_2Sb$ potential for short periods.

Halide solvents, particularly chlorides, have low enough melting points so that eutectics of halides are often used as molten solvents. The melting point of organic halide solvents are as low as room temperature. A particularly suitable inorganic halide solvent is LiCl-KCl which melts below 400° C. The $Li_2Sb$ electrodes will not react with halide solvents composed of alkali, alkaline earth, rare earth, and/or actinide halide even if directly exposed to the solvent materials.

Halide solvents are good media from which various metals such as individual or groups of actinides, individual or groups of rare earths, magnesium, aluminum or other metals can be recovered in purified form by electrorefining these metals from such solvents. Such electrorefining operations can be controlled to isolate specific metals or groups of metals by using the $Li_2Sb$ electrode to control the potential of one or both of the working electrodes in the electrorefining operation so that only the desired metals can be electrodeposited.

The $Li_2Sb$ electrode can be used as a working electrode (i.e., used as anode or cathode) and still provide a reference potential after operation as a working electrode. When used as an anode, reaction 3 occurs; while used as a cathode, reaction 4 occurs if a lower potential material is not present. Otherwise, the lower potential material will plate out (reaction 5).

$$Li_2Sb_{(S)} \rightarrow Li^+ + Li_2Sb_{(S)} + e- \quad (3)$$

$$Li^+ + e- + Li_2Sb_{(S)} \rightarrow Li_2Sb_{(S)} \quad (4)$$

$$Li_2Sb + MCl_3 \rightarrow 3LiCl + M \quad (5)$$

where M is an active metal (U, Pu, Np, Am, Cm, rare earths, etc.). $Li_2Sb$ is such a stable electrode that the deposition reaction can be voltage controlled with minimal overvoltage so that good rare earth/actinide separations can be achieved.

On the other hand, the LiAl electrode would drive the reaction so hard that rare earth/actinide separations would be much poorer and active metal would plate out not only at the cathode but also on the LiAl electrode.

As an illustration of the reproducible potential that can be achieved after numerous uses as a working electrode, the measured potential after numerous anodizations are in excellent agreement ($\pm 1.5$ mV) with the original potential of the electrodes. At the conclusion of tests at 450° C., nearly 10% of the lithium in the electrode had been removed by using the reference electrode as a working anode. Examination of the data indicates that the $Li_2Sb$ electrode potential was $1.548 \pm 0.002$ V versus the silver/silver chloride reference electrode at 450° C.

Although the present invention has been described with reference to the preferred embodiment thereof, many modifications and alterations may be made within the scope of the appendant claims.

What is claimed is:

1. A metallic electrolytic electrode comprising a metal base and, on at least a portion of said metal base, a conductive material consisting essentially of 5 to 50 atom percent metallic lithium and 50 to 95 atom percent metallic antimony.

2. A metallic electrolytic electrode as claimed in claim 1 wherein said metal base is selected from the group consisting of tantalum, platinum, tungsten and iron.

3. A metallic electrolytic electrode as claimed in claim 1 which produces a standard reference potential against which other unknown potentials can be measured so that the electrochemical potentials of the other material can be correlated with the thermodynamic properties of the other material and chemical reactions in which the other material takes part.

4. A metallic electrolytic electrode as claimed in claim 3 where the standard reference potential applies a controlled potential to the metallic electrode for controlling the chemical reactions through a feed back mechanism.

* * * * *